US008011953B2

(12) United States Patent
Suzuki et al.

(10) Patent No.: US 8,011,953 B2
(45) Date of Patent: Sep. 6, 2011

(54) RELAY CONNECTOR

(75) Inventors: Hisashi Suzuki, Tokyo (JP); Ryoichi Hirako, Tokyo (JP); Yasunobu Ishii, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 12/622,918

(22) Filed: Nov. 20, 2009

(65) Prior Publication Data

US 2010/0124841 A1 May 20, 2010

(30) Foreign Application Priority Data

Nov. 20, 2008 (JP) ..... P. 2008-296620

(51) Int. Cl.
*H01R 9/05* (2006.01)

(52) U.S. Cl. ..... 439/581; 439/540.1

(58) Field of Classification Search ..... 439/540.1, 439/581, 63

See application file for complete search history.

(56) References Cited

U.S. PATENT DOCUMENTS 7,484,999 B2 * 2/2009 Suzuki et al. ..... 439/581

FOREIGN PATENT DOCUMENTS

JP 2003-187933 A 7/2003
JP 2008-171801 7/2008

* cited by examiner

*Primary Examiner* — Edwin A. Leon
*Assistant Examiner* — Vanessa Girardi
(74) *Attorney, Agent, or Firm* — Morgan, Lewis & Bockius LLP

(57) ABSTRACT

A relay connector for electrically connecting a board and a coaxial connector including a shell GND, a dielectric member and a core conductor, includes: a conductive first block including a first surface from which the core conductor is projected and a second surface to which the shell GND is fixed, and provided with a guide pin extending in a first direction parallel to the first surface; a conductive second block including a board rest part on which the board is to be mounted and a guide hole into which the guide pin is inserted, and being electrically connected to the first block; an operating member, provided on the first block at an opposite side to the second block; an elastic member provided between the operating member and the first block in a contracted state; and a coupling member, one end of which is fitted into and fixed to a first groove of the second block, the other end of which is fitted into and fixed to a second groove of the operating member.

5 Claims, 14 Drawing Sheets

RELATED ART

RELATED ART

RELAY CONNECTOR

This application claims the benefit of Japanese Patent Application No. 2008-296620, filed Nov. 20, 2008, which is hereby incorporated by reference.

BACKGROUND OF THE INVENTION

The present invention relates to a relay connector for electrically connecting a core conductor of a coaxial connector to a terminal electrode which is provided on a surface of a board, and at the same time, electrically connecting a shell ground (GND) of the coaxial connector to a GND electrode which is provided on a back face of the board, for the purpose of inspecting the board.

In designing and producing a high frequency circuit board or the like, it is necessary to evaluate its performance in the process of designing. For this purpose, a core conductor of a coaxial connector is electrically connected to a terminal electrode which is provided at an end part of a surface of a board, and at the same time, a shell GND of the coaxial connector is electrically connected to a GND electrode which is provided at an end part of a back surface of the board, thereby to conduct evaluation of the performance based on the high frequency signal obtained from the terminal electrode. In case where soldering is employed in electrically connecting the core conductor of the coaxial connector to the terminal electrode and in electrically connecting the shell GND of the coaxial connector to the GND electrode, such soldering process is troublesome. Moreover, a process for removing the coaxial connector which has been soldered and fixed to the board is also troublesome. Therefore, a related-art relay connector in which the coaxial connector can be mounted to the board without soldering has been proposed (refer to JP-A-2008-171801).

The related-art relay connector disclosed in JP-A-2008-171801 will be briefly described referring to FIGS. 12A to 14. FIGS. 12A, 12B and 12C are views showing an outer appearance of the related-art relay connector, FIG. 12A is a side view, FIG. 12B is a plan view, and FIG. 12C is a front view. FIG. 13 is a sectional view taken along a line A-A in FIG. 12B. FIG. 14 is an exploded perspective view of the relay connector as shown in FIGS. 12A to 12C. In the related-art relay connector as shown in FIGS. 12A to 14, a main block 20 formed of conductive material is provided with a through hole 20*a*, and a dielectric member 22*b* projected from a shell GND 22*a* of a coaxial connector (SMA type connector, for example) 22 is inserted into the through hole 20*a* from a backside surface, and the shell GND 22*a* is fixed to the backside surface with screws, and electrically connected thereto. Further, a core conductor 22*c* peeled out of the dielectric member 22*b* is projected from a front surface of the main block 20. In this state, an end surface of the dielectric member 22*b* is substantially flush with the front surface of the main block 20 or retracted from the front surface. An axial direction of the core conductor 22*c* is perpendicular to the front surface of the main block 20. Guide pins 24, 24 are uprightly provided on the main block 20 in parallel with the front surface. A ground (GND) block 26 formed of conductive material is formed with guide holes 26*a*, 26*a* into which the guide pins 24, 24 are inserted. In this structure, by inserting and withdrawing the guide pins 24, 24 into and from the guide holes 26*a*, 26*a*, the GND block 26 can relatively move with respect to the main block 20 in slidably contact, in a linear direction parallel to the front surface thereof. Further, the GND block 26 is provided with a board rest part 26*b* so as to be opposed to the core conductor 22*c* in such a manner that the board rest part 26*b* can relatively move in a direction of approaching and separating with respect to the core conductor 22*c*.

Further, an operating member 30 is provided so as to relatively move in a direction of approaching and separating with respect to the main block 20 in a determined range, by inserting moving range limiting screws 32, 32 into moving range limiting through holes 30*a*, 30*a* which are formed in a vertical direction passing through the operating member 30, in an axial direction so as to move in a determined range, and screwing distal ends of the screws into the main block 20 at an opposite side to a side where the GND block 26 is provided, with respect to the core conductor 22*c*. The direction of the GND block 26 approaching and separating with respect to the core conductor 22*c*, and the direction of the operating member 30 approaching and separating with respect to the main block 20 are parallel to each other. In addition, elastic springs 34, 34 are provided between the operating member 30 and the main block 20 in a contracted state, and the operating member 30 is elastically urged so as to be separated from the main block 20. Further, the operating member 30 and the GND block 26 are coupled by means of coupling members 38, 38 with coupling pins 36, 36. The coupling members 38, 38 move the GND block 26 so as to approach and separate with respect to the core conductor 22*c*, following the movement of the operating member 30 in the approaching and separating direction. Still further, a leaf spring 40 having conductivity is fixed to the GND block 26 with small screws, and the GND block 26 is slidably disposed so as to be brought into elastic contact with the main block 20 which relatively moves in the approaching and separating direction, and electrically connected thereto. A lateral width W of the related-art relay connector is set to be 12.7 mm, for example, that is, the same size as a lateral width of the shell GND 22*a* of the coaxial connector 22.

In the related-art relay connector disclosed in JP-A-2008-171801, a distance between the core conductor 22*c* and the board rest part 26*b* is enlarged by the relative movement between the main block 20 and the GND block 26, whereby the board can be inserted between the core conductor 22*c* and the board rest part 26*b*, and the core conductor 22*c* is moved close to the board rest part 26*b* by the relative movement, whereby the board can be clamped between the core conductor 22*c* and the board rest part 26*b*. The core conductor 22*c* of the coaxial connector 22 is brought into contact with a terminal electrode provided on the surface of the board, and electrically connected thereto. Moreover, a GND electrode provided on aback surface of the board is electrically connected to the shell GND 22*a* of the coaxial connector 22 from the GND block 26 having the board rest part 26*b*, by way of the main block 20. In this manner, electrical connection between the board and the coaxial connector 22 can be easily performed. Moreover, by enlarging the distance between the core conductor 22*c* and the board rest part 26*b* by the relative movement, the board which has been inserted between the core conductor 22*c* and the board rest part 26*b* can be easily removed. In addition, by pressing the operating member 30 against elasticity of the elastic members 34, 34 to be moved toward the main block 20, the board rest part 26*b* of the GND block 26 which is coupled to the operating member 30 by means of the coupling members 38, 38 relatively moves to be separated from the core conductor 22*c*, and the board can be inserted between the core conductor 22*c* and the board rest part 26*b* which have been separated. When the pressure on the operating member is released, it is possible to clamp the board between the core conductor 22*c* and the board rest part 26*b* with the elasticity.

The related-art relay connector disclosed in JP-A-2008-171801 is excellent in that electrical connection between the board and the coaxial connector 22 can be easily performed. However, it is desired that posture of the GND block 26 is more stabilized with respect to the main block 20. Although the posture of the GND block 26 is restricted by detachably inserting the guide pins 24, 24 into the guide holes 26*a*, 26*a*, the posture is likely to become unstable because of slight clearances which are required for smooth insertion and smooth withdrawal of the guide pins. Moreover, although the coupling members 38, 38 are coupled to the GND block 26 by means of the coupling pins 36, 36, the coupling members 38, 38 can relatively rotate with respect to the GND block 26 around the coupling pins 36, 36, and hence, do not function for stabilizing the posture of the GND block 26. For these reasons, the posture of the GND block 26 is not stabilized with respect to the main block 20, and constant electrical connection between the main block 20 and the GND block 26 cannot be necessarily obtained. In case where the posture of the GND block 26 is unstable, the contact between the board rest part 26*b* and the GND electrode on the back surface of the board is also varied, which will make a path of the electrical connection from the GND electrode on the board to the main block 20 unstable, and there is such a drawback in that electrical performance of the path may be varied at every time when the performance is evaluated.

SUMMARY

It is therefore an object of the invention to provide a relay connector in which posture of a GND block with respect to a main block is stabilized.

In order to achieve the object, according to the invention, there is provided a relay connector for electrically connecting a board and a coaxial connector, the coaxial connector including: a shell GND; a dielectric member projected from the shell GND; and a core conductor peeled out of the dielectric member, the relay connector comprising:

a conductive first block including a first through hole into which the dielectric member is inserted, the first block including a first surface from which the core conductor is projected and a second surface which is opposite to the first surface and to which the shell GND is fixed, the first block provided with a guide pin extending in a first direction parallel to the first surface;

a conductive second block including a board rest part on which the board is to be mounted, the second block including a guide hole into which the guide pin is inserted, the second block formed with a first groove, the second block being electrically connected to the first block and being movable in the first direction in slidably contact with the first block;

an operating member provided on the first block at an opposite side to the second block with respect to the core conductor, the operating member formed with a second groove, the operating member including a second through hole which extends in the first direction and into which a screw being screwed into the first block is inserted, the operating member being movable in the first direction;

an elastic member provided between the operating member and the first block in a contracted state to elastically urge the operating member so as to move apart from the first block; and a coupling member, one end of which is fitted into and fixed to the first groove of the second block, the other end of which is fitted into and fixed to the second groove of the operating member.

The first groove of the second block may extend in a second direction perpendicular to the first direction and the second groove of the operating member may extend in the first direction. The coupling member may include a first portion which extends in the first direction and which is fitted into the second groove and a second portion which extends in the second direction and which is fitted into the first groove so that the coupling member has a substantially L-shape.

The relay connector may further include: a conductive surface GND rest member disposed on the first surface of the first block at an opposite side to the second block with respect to the core conductor, the surface GND rest member including a surface which is opposed to and parallel with the board rest part of the second block and which is formed with a recess so as not to be in electrically contact with the core conductor.

An end part of the first block at an opposite side to a side at which the operating member is provided may be inserted into a slide rail, the slide rail elongated in a second direction perpendicular to the first direction, the slide rail having at least one opening being opened to the first block, the slide rail fixed to the first block by a screw so as to be movable in the second direction.

The first block may be formed with a groove in which the coupling member is fitted and along which the coupling member moves in the first direction.

BRIEF DESCRIPTION OF THE DRAWINGS

FIG. 1A is a side view, FIG. 1B is a plan view, and FIG. 1C is a front view.

FIG. 3A shows a state where the lever member is laterally tilted whereby a board is clamped, and FIG. 3B shows a state where the lever member is erected so that the board can be inserted.

FIG. 4A shows a state where the lever member is laterally tilted whereby the board is clamped, and FIG. 4B shows a state where the lever member is erected so that the board can be inserted.

FIG. 5A shows a state where the lever member is laterally tilted whereby the board is clamped, and FIG. 5B shows a state where the lever member is erected so that the board can be inserted.

FIG. 8A shows a state where the board is not clamped, and FIG. 8B shows a state where the board is clamped.

FIG. 12A is a side view, FIG. 12B is a plan view, and FIG. 12C is a front view.

DETAILED DESCRIPTION OF EMBODIMENTS

Figure 1B:
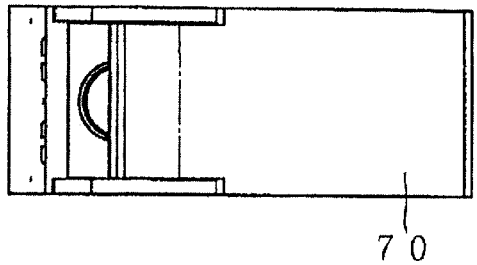
FIGS. 1A, 1B and 1C are views showing an outer appearance of a relay connector in a first embodiment according to the invention.
Figure 1C:
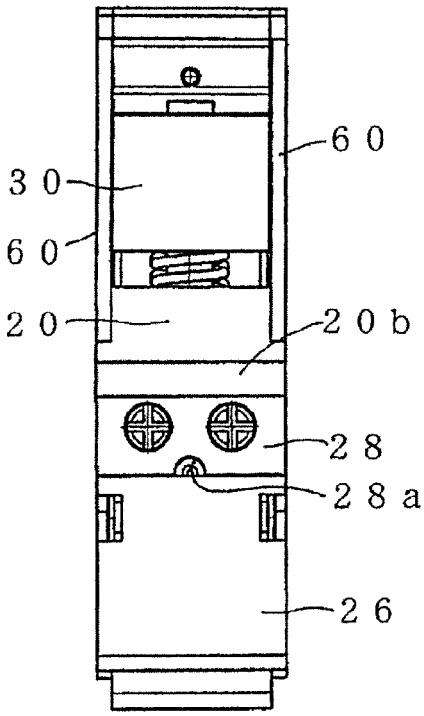
Figure 1A:
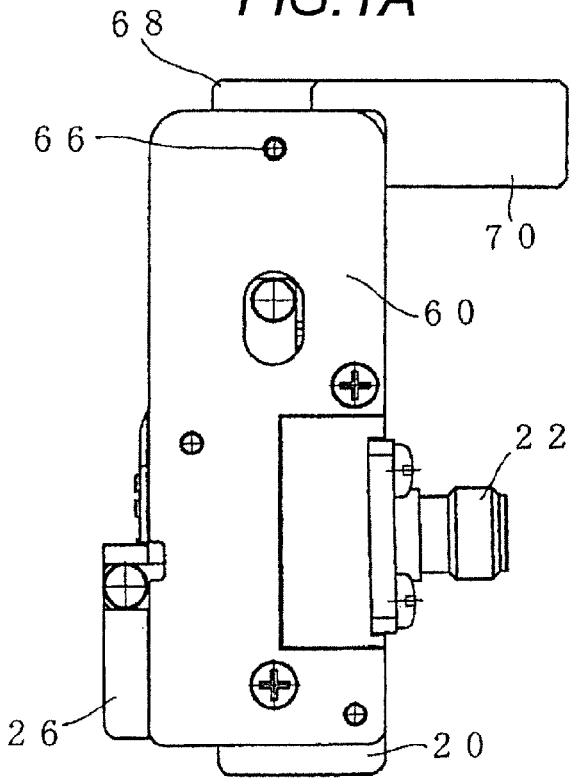
Figure 2:
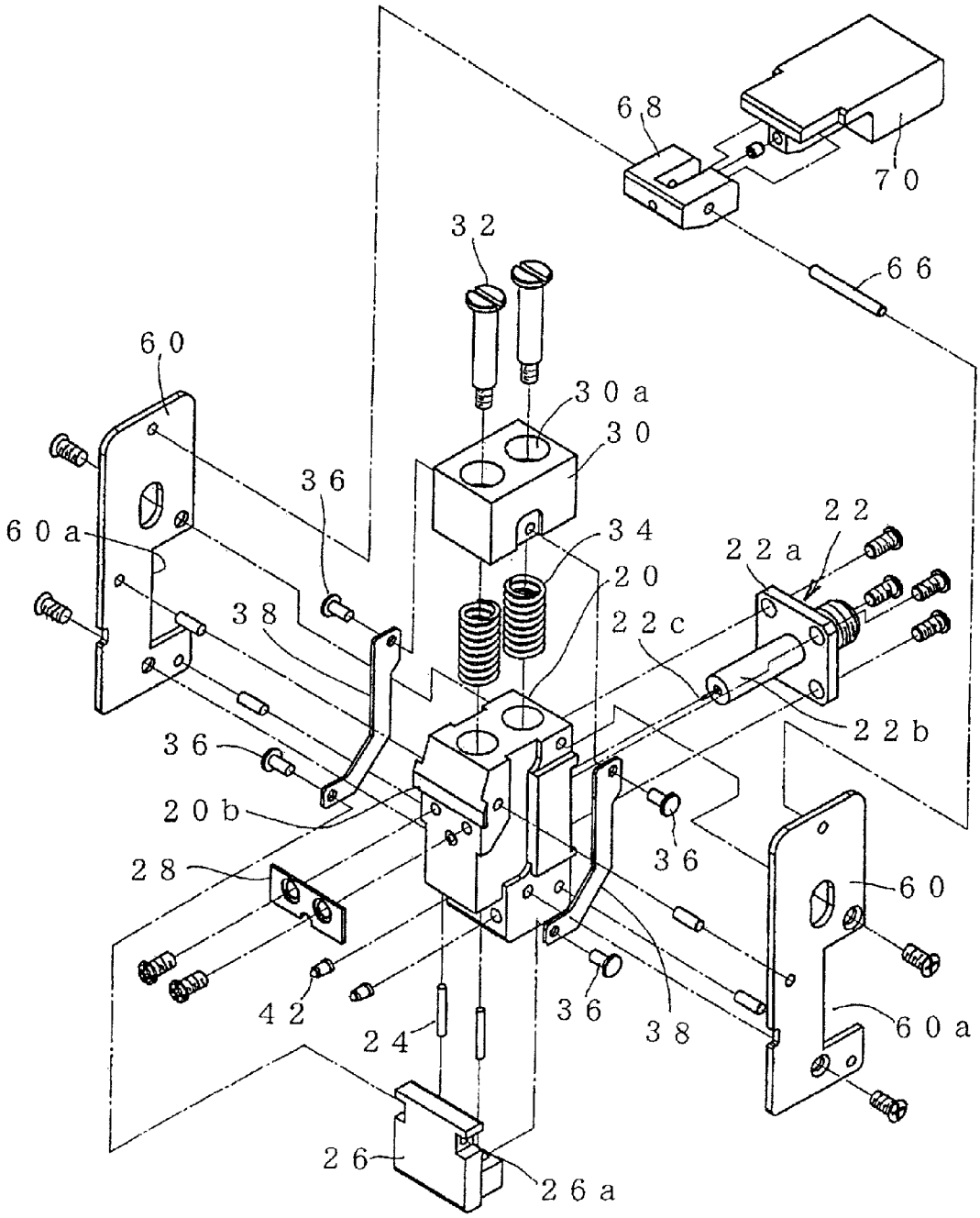
FIG. 2 is an exploded perspective view of the relay connector in FIG. 1.

Now, a first embodiment of the invention will be described referring to FIGS. 1A to 8B. In FIGS. 1 to 8, those members which are the same or equivalent to the members in FIGS. 12A to 14 will be denoted with the same reference numerals, and overlapped descriptions will be omitted.

Figure 5A:
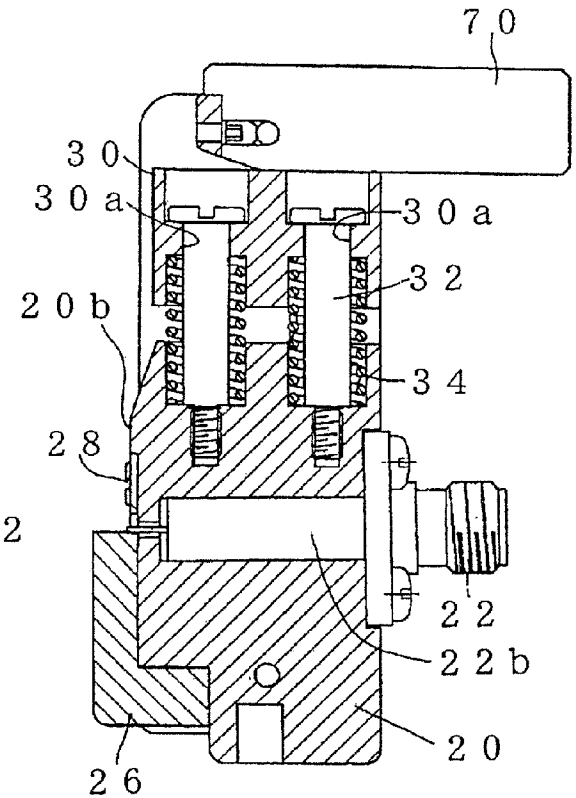
FIGS. 5A and 5B are vertical sectional views of the relay connector having the lever member in FIGS. 3A and 3B oscillated.
Figure 5B:
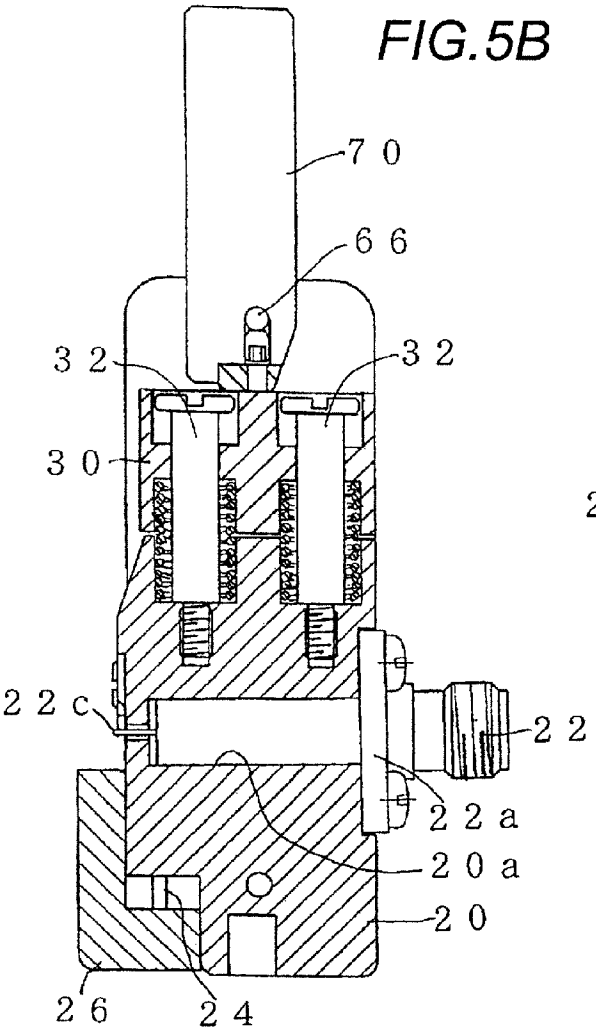
Figure 6:
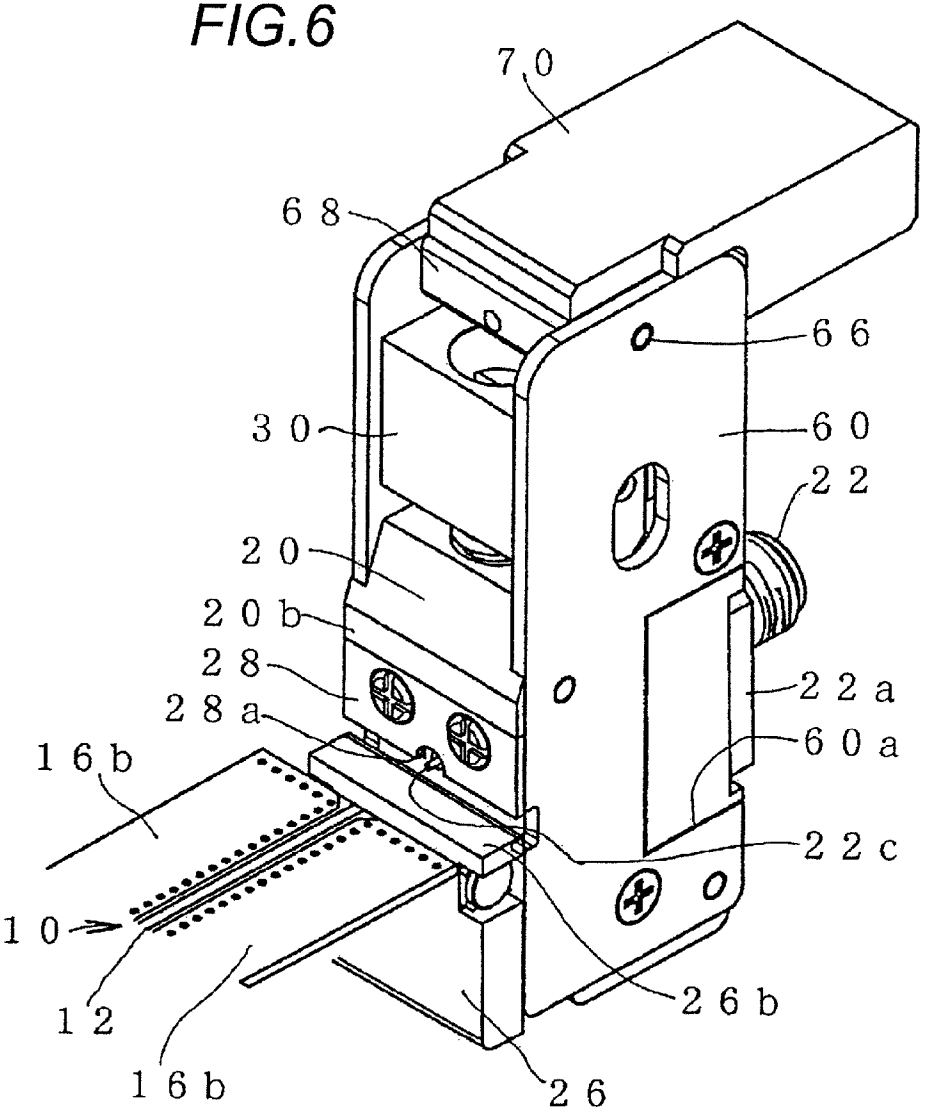
FIG. 6 is a perspective view showing the outer appearance of the relay connector in the first embodiment of the invention which is going to clamp the board.
Figure 7:
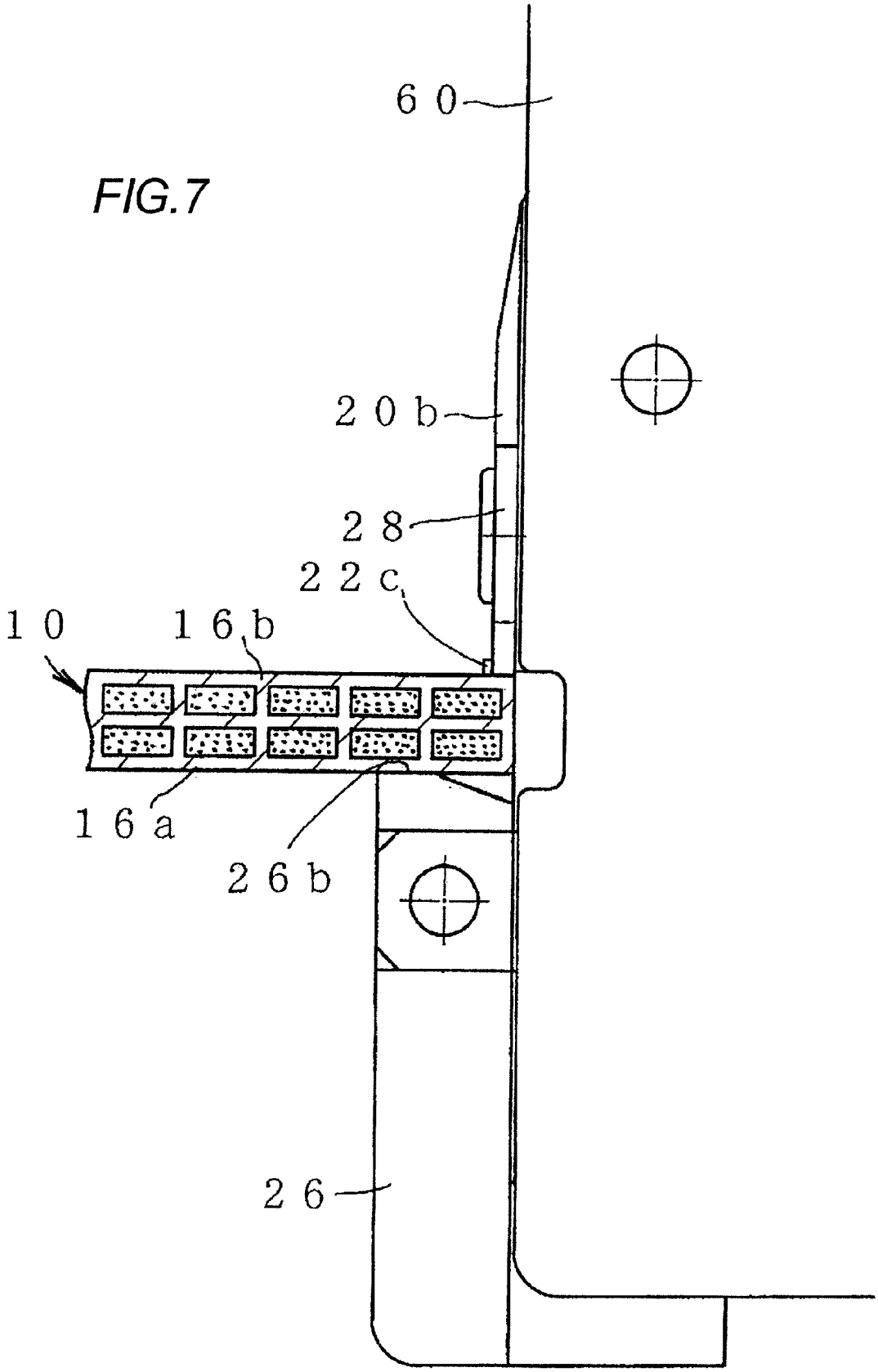
FIG. 7 is a side view showing a board rest part of a GND block in FIG. 1.
Figure 8A:
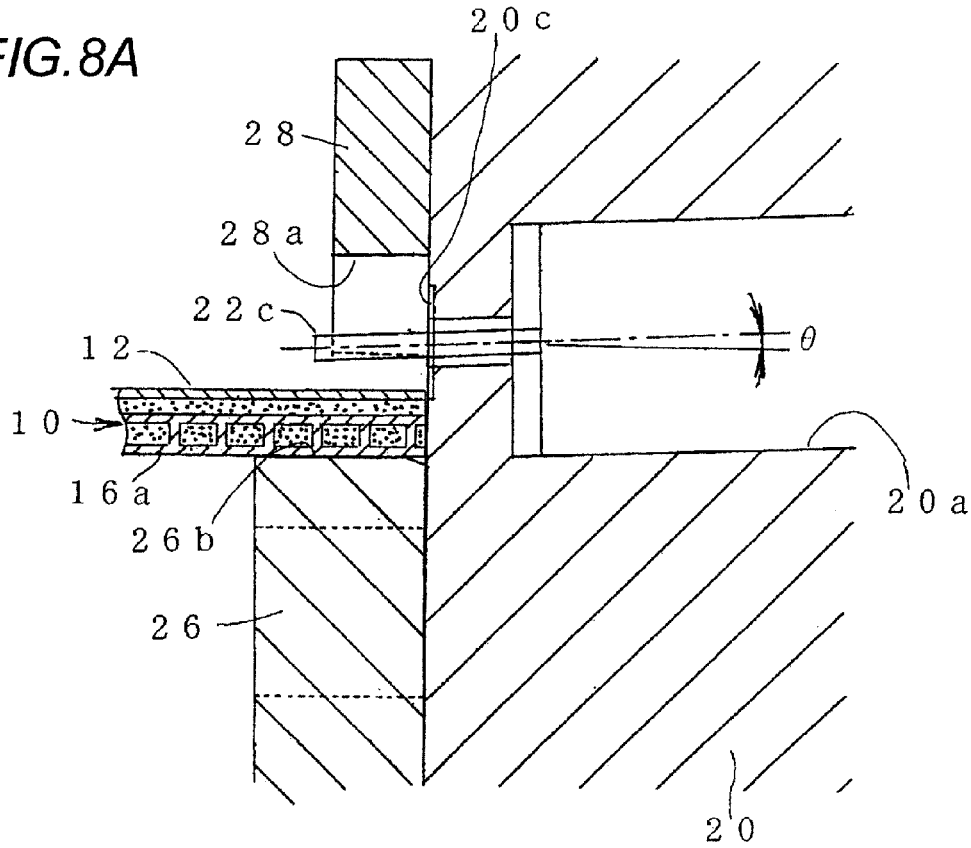
FIGS. 8A and 8B are views showing details of a structure in which a core conductor is projected from a main block.
Figure 8B:
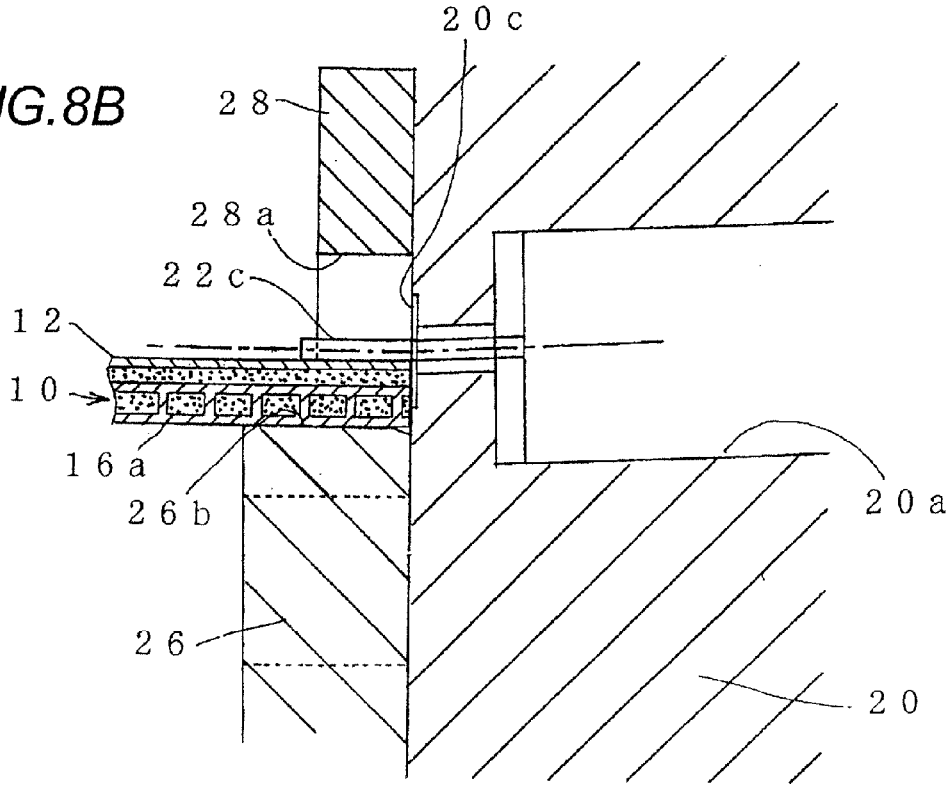

In FIGS. 1A to 8B, in the first embodiment of the relay connector according to the invention, a main block 20 formed of conductive material is provided with a through hole 20*a*, and a dielectric member 22*b* projected from a shell GND 22*a* of a coaxial connector (SMA type connector, for example) 22 is inserted into the through hole 20*a* from a backside surface. Then, the shell GND 22*a* is fixed to the backside surface with screws, and electrically connected thereto. Further, a core conductor 22*c* peeled out of the dielectric member 22*b* is projected from a front surface of the main block 20. In this state, an end surface of the dielectric member 22*b* is retracted from the front surface of the main block 20 (the end surface of the dielectric member 22*b* may be substantially flush with the front surface of the main block 20, provided that it is not projected from the front surface). An axial direction of the core conductor 22*c* is substantially perpendicular to the front surface of the main block 20, but the core conductor 22*c* is provided so as to be slightly inclined downward at a distal end side by an inclination θ, as shown in FIG. 8A. Guide pins 24, 24 are uprightly provided on the main block 20 in parallel with the front surface. A GND block 26 formed of conductive material is provided with guide holes 26*a*, 26*a* into which the guide pins 24, 24 are inserted. The GND block 26 can relatively move while sliding with respect to the main block 20 in a linear direction in parallel with the front surface thereof, by inserting the guide pins 24, 24 into and from the guide holes 26*a*, 26*a* so as to freely move. Moreover, spring connectors 42, 42 are embedded in the main block 20 on a sliding contact surface of the main block 20, which the GND block 26 is in slidably contact with, and elastically contacted with a sliding contact surface of the GND block 26, which the main block 20 is in slidably contact with, whereby electrical connection between the main block 20 and the GND block 26 can be achieved. Further, the GND block 26 is provided with a board rest part 26*b* so as to be opposed to the core conductor 22*c*, so that the board rest part 26*b* can move in a direction of approaching and separating with respect to the core conductor 22*c* by relative movement. In the board rest part 26*b*, an edge close to the main block 20 is chamfered so as not to interfere with an end of a back surface of a board 10, as shown in FIG. 7. Moreover, a surface GND rest member 28 formed of conductive material is fixed with screws to the front surface of the main block 20 at an opposite side to the board rest part 26*b* in the approaching and separating direction. An upper surface and a lower surface of the surface GND rest member 28 are formed in parallel with each other, and a recess 28*a* in a semicircular shape is provided on the lower surface, for avoiding contact with the core conductor 22*c* so as not to be electrically connected thereto. Further, a positioning projection 20*b* whose lower surface is parallel to the board rest part 26*b* is provided on the front surface of the main block 20 above a position where the surface GND rest member 28 is fixed. Therefore, the surface GND rest member 28 can be fixed to the front surface of the main block 20 having its lower surface made parallel to the board rest part 26*b*, by abutting its upper surface against the lower surface of the positioning projection 20*b* to be restricted in position and posture . In addition, as shown in FIGS. 8A and 8B, the lower surface of the surface GND rest member 28 is set at a slightly upper position than the lower end of the core conductor 22*c* at a distal end side which is projected from the main block 20 in a substantially perpendicular direction but slightly inclined downward at the distal end side by the inclination θ.

Then, the moving range limiting screws 32, 32 are inserted into the moving range limiting through holes 30*a*, 30*a* which are provided in the vertical direction passing through the operating member 30 so as to move in a determined range. Distal ends of the screws 32, 32 are uprightly screwed into the main block 20 at the opposite side to the side where the GND block 26 is disposed, and the operating member 30 is disposed so as to relatively move in a direction of approaching and separating with respect to the main block 20 in a determined range. In this state, the approaching and separating direction of the GND block 26 with respect to the core conductor 22*c* is in parallel with the approaching and separating direction of the operating member 30 with respect to the main block 20. In addition, the elastic springs 34, 34 are provided in a contracted state between the operating member 30 and the main block 20, and the operating member 30 is elastically urged so as to be separated from the main block 20. Further, the operating member 30 and the GND block 26 are coupled to each other on their both side surfaces, by means of the coupling members 38, 38 formed in a substantially L-shape, with the coupling pins 36, 36. In this embodiment, grooves 30*b*, 30*b* which are parallel to the moving direction of the GND block 26 are provided on both side surfaces of the operating member 30. These grooves 30*b*, 30*b* have a width W1 which is equal to a width of upper portions of the coupling members 38, 38 having the substantially L-shape. The upper portions of the coupling members 38, 38 are inserted into these grooves 30*b*, 30*b* and fixed with the coupling pins 36, 36, whereby the operating members 30 and the coupling members 38, 38 are made integral with each other so as not to relatively rotate. Moreover, grooves 26*c*, 26*c* having a width W2 which is equal to a width of side end portions of the coupling members 38, 38 having the substantially L-shape are provided on both the side surfaces of the GND block 26 in a direction perpendicular to the moving direction of the GND block 26. The side end portions of the coupling members 38, 38 are inserted into these grooves 26*c*, 26*c* and fixed with the coupling pins 36, 36, whereby the GND block 26 and the coupling members 38, 38 are made integral with each other so as not to relatively rotate. As the results, the operating member 30, the GND block 26, and the coupling members 38, 38 are made integral with one another so as not to relatively rotate. Grooves in which the coupling members 38, 38 are fitted are formed in the main block 20. The coupling members 38, 38 move along the grooves in the approaching and separating direction. In this state, the GND block 26 moves in the approaching and separating direction, following the movement of the operating member 30 in the approaching and separating direction. On this occasion, because the moving direction of the GND block 26 is restricted by the guide pins 24, 24 and the guide holes 26*a*, 26*a*, and the moving direction of the operating member 30 is also restricted by the moving range limiting through holes 30*a*, 30*a* and the moving range limiting screws 32, 32, the moving directions of both the GND block 26 and the operating member 30 which have been made integral are restricted. Therefore, the posture of the GND block 26 when the GND block 26 slides with respect to the main block 20 will not be changed. Further, the GND block 26 is slidably and elastically contacted with the main block 20 which relatively moves thereby to be electrically connected thereto, and at the same time, electrically connected to the main block 20 by means of the spring connectors 42, 42.

Further, frame bodies 60, 60 formed of sheet metal are provided on both the side surfaces of the main block 20, and fixed to the main block 20 with screws. In this embodiment, it is desirable that a width of the main block 20 in a state provided with the frame bodies 60, 60 on both the side surfaces is set to be 12.7 mm, for example, which is equal to a lateral width of the shell GND 22*a* of the coaxial connector 22. For this reason, the frame bodies 60, 60 are provided with cutouts 60*a*, 60*a* at positions opposed to the shell GND 22*a*, and both the side surfaces of the main block 20 are dented by a thickness of the frame bodies 60, 60, except the positions opposed to the shell GND 22*a*. Upper end portions of the frame bodies 60, 60 at both sides are extended upward above the operating member 30, and an oscillation support shaft 66 is rotatably disposed at distal ends of the upper end portions of the frame bodies 60, 60 in a direction perpendicular to the moving direction of the operating member 30. A pressing block 68 and a lever member 70 are fixed to this oscillation support shaft 66 with screws. The pressing block 68 has a substantially oblong square shape in section perpendicular to the oscillation support shaft 66, and the oscillation support shaft 66 passes through the pressing block 68 at a substantially center position thereof. By operating the lever member 70 to be oscillated between an erected state and a laterally tilted state, the operating member 30 is pressed downward, and released from the pressed state. Outsides of the coupling members 38, 38 are restricted by the frame bodies 60, 60. Moreover, the frame bodies 60, 60 are provided with cutouts at positions opposed to the board rest part 26*b* so that an end of the board 10 may not directly interfere with the frame bodies 60, 60.

Figure 3B:
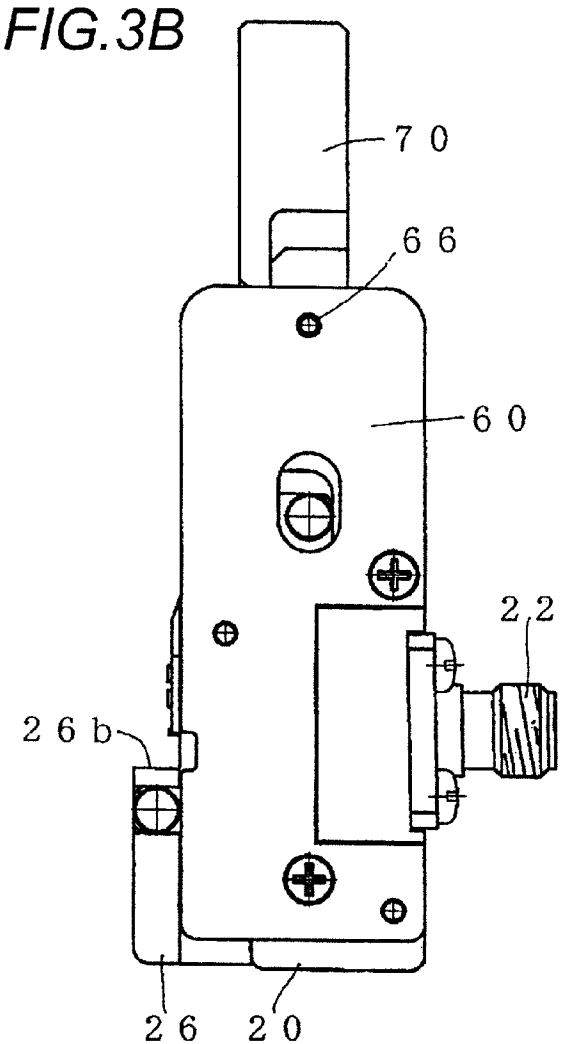
FIGS. 3A and 3B are side views of the relay connector as shown in FIG. 1 having a lever member oscillated.
Figure 3A:
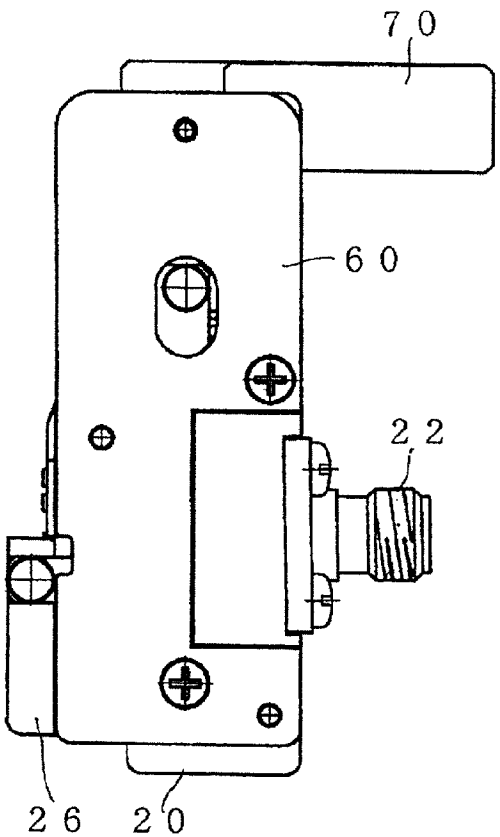
Figure 4B:
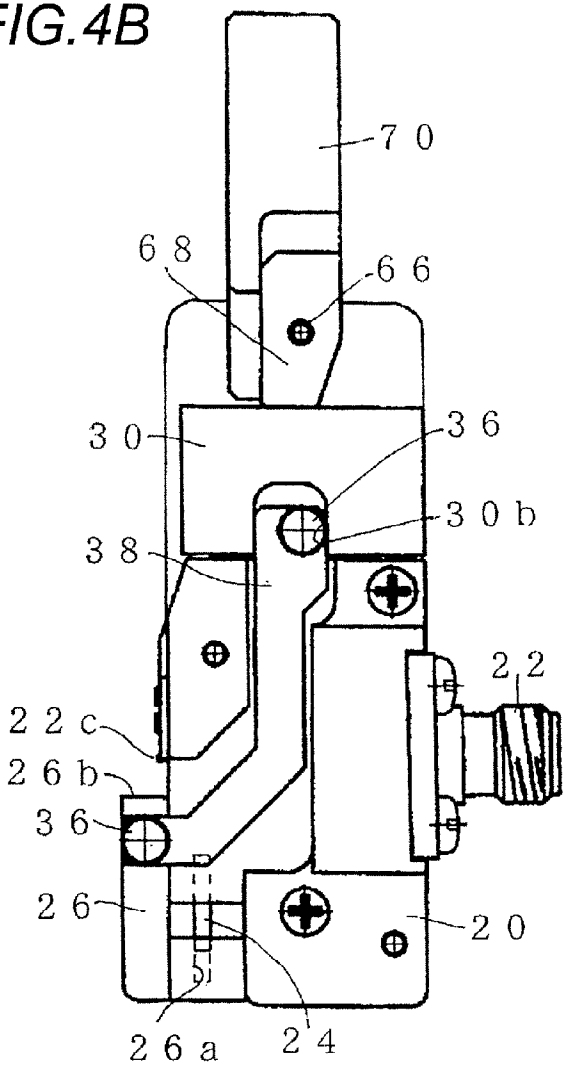
FIGS. 4A and 4B are side views of the relay connector in which a frame provided on a side face in FIGS. 3A and 3B is removed, and the lever member is oscillated.
Figure 4A:
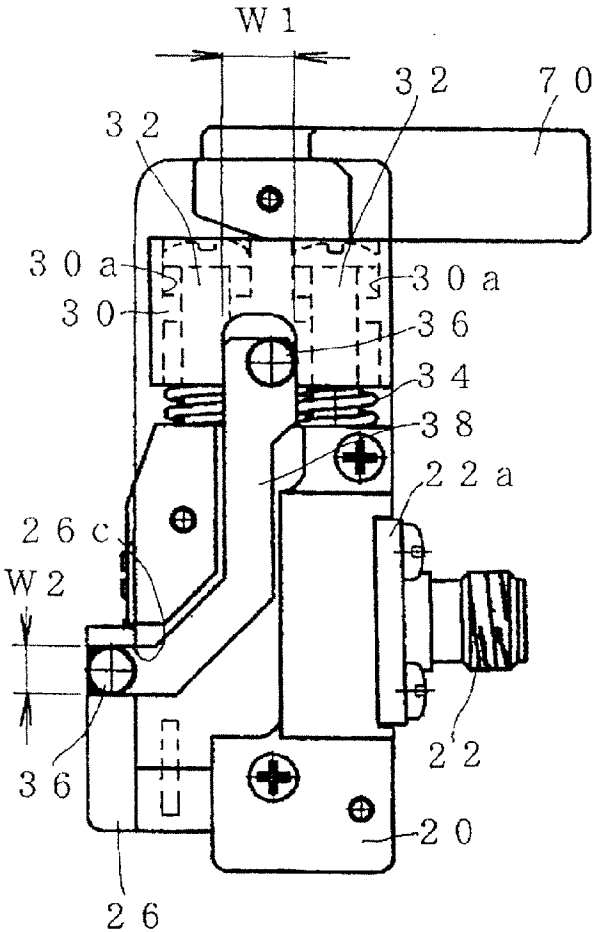

In the above described structure, in the erected state of the lever member 70, as shown in FIGS. 3B, 4B, and 5B, an edge of the pressing block 68 remote from the oscillation support shaft 66 is in contact with the operating member 30, and presses the operating member 30 in the approaching and separating direction against elasticity of the elastic springs 34, 34. Then, the GND block 26 coupled by means of the coupling members 38, 38 relatively moves with respect to the main block 20, and the board rest part 26*b* is moved apart from the core conductor 22*c*, whereby the distance between the board rest part 26*b* and the core conductor 22*c* is enlarged. Then, the board 10 is positioned between the core conductor 22*c* and the board rest part 26*b*, and inserted, as shown in FIG. 6. On the other hand, in the tilted state of the lever member 70, as shown in FIGS. 3A, 4A, and 5A, the edge of the pressing block 68 close to the oscillation support shaft 66 is opposed to the operating member 30 thereby to release the operating member 30 from the pressure, and the operating member 30 is moved apart from the main block 20 by the elasticity of the elastic springs 34, 34. Accordingly, the board rest part 26*b* moves so as to approach the core conductor 22*c*. As the results, the board 10 can be clamped between the core conductor 22*c* and the board rest part 26*b*, as shown in FIGS. 7 and 8B. On occasion of inserting the board 10, it is possible to easily position the board 10 with respect to the core conductor 22*c*, by arranging a terminal electrode 12 provided in an end part of a front surface of the board 10 so as to be opposed to a distal end portion of the core conductor 22*c*. When the board 10 has been clamped, the terminal electrode 12 is brought into contact with the core conductor 22*c* to be electrically connected, and a GND electrode 16*a* provided in an end part of a back surface of the board 10 is electrically connected to the shell GND 22*a* by way of the GND block 26 having the board rest part 26*b*, and the main block 20 in series. In this manner, the terminal electrode 12 of the board 10 and the GND electrode 16*a* in the end part of the back surface are electrically connected to the coaxial connector 22.

By the way, burr or deformation is likely to occur in the end part of the board 10. For the purpose of avoiding occurrence of the burr or deformation, the end part of the board rest part 26*b* of the GND block 26 close to the main block 20 is chamfered, as shown in FIG. 7. In recent years, there is such a board 10 as provided with the GND electrode 16*b* on the surface. It is of course impossible to electrically connect the board rest part 26*b* of the GND block 26 to the GND electrode 16*b* on the surface of the board 10 of this related-art type. Therefore, a surface GND rest member 28 formed of conductive material is fixed with screws to the surface of the main block 20 at the side opposite to the board rest part 26*b* with respect to the core conductor 22*c* in the approaching and separating direction, so that the surface GND rest member 28 can be brought into contact with the GND electrode 16*b* provided on the surface of the board 10 for electrical connection. In this case, the board 10 is sandwiched between the board rest part 26*b* and the surface GND rest member 28, and for equally supporting the board 10, a surface of the board rest part 26*b* to be contacted with the board 10 and a surface of the surface GND rest member 28 to be contacted with the board 10 must be precisely parallel to each other. Moreover, it is required that the surface GND rest member 28 can be exchanged according to a position of the GND electrode 16*b* on the surface of the board 10. For this reason, the surface GND rest member 28 is fixed with screws so as to be easily exchanged, and its posture in a fixed state is restricted by a positioning projection 20*b* which is provided on the main block 20, whereby the lower surface of the surface GND rest member 28 can be made parallel to the board rest part 26*b*. At least double of a width of the terminal electrode 12 is required for a diameter of a semicircular recess 28*a* formed in the surface GND rest member 28, so that both the core conductor 22*c* and the surface GND rest member 28 may not interfere with the terminal electrode 12 of the board 10, even in case where the board 10 is displaced. Moreover, the diameter of the recess 28*a* is set to be equal to a distance between the two GND electrodes 16*b* and 16*b* which are provided at both sides of the terminal electrode 12, as shown in FIG. 6, or larger than the distance, so that it can be brought into contact with the two GND electrodes 16*b*, 16*b*. Further, it is desirable that a thickness of the surface GND rest member 28 is as small as possible from a viewpoint of electrical performance, so that impedance of a signal path can be maintained at 50Ω. However, it can be appropriately set considering mechanical strength and a case where the GND electrodes 16*b*, 16*b* are set back from the end part of the board. Anyway, the thickness is preferably about 0.2 mm. By providing this surface GND rest member 28, the relay connector can be applied to the board 10 which is provided with the GND electrodes 16*b*, 16*b* on the surface thereof, and also can be applied to the board 10 which is provided with the GND electrodes 16*a*, and 16*b*, 16*b* on both the back surface and the front surface of the board 10.

As described above, the axial direction of the core conductor 22*c* has the inclination θ so that the distal end side is slightly inclined downward with respect to the front surface of the main block 20, as shown in FIG. 8A, and the lower surface of the surface GND rest member 28 is positioned at a slightly upper position than the lower end of the core conductor 22*c* at the distal end side. Therefore, when the core conductor 22*c* is elastically contacted with the terminal electrode 12 of the board 10, as a first step, the lower surface of the distal end part of the core conductor 22 is brought into contact with the terminal electrode 12. Following this contact, the core conductor 22*c* is elastically deformed, and comes into elastic contact with the terminal electrode 12 so as to move along the terminal electrode 12, and thereafter, the surface GND rest member 28 comes into contact with the GND electrodes 16*b*, 16*b* on the surface of the board 10. The lowermost end of the core conductor 22*c* is positioned lower than the lower surface of the surface GND rest member 28 by unit of several ten microns, for example. In this manner, the core conductor 22*c* and the surface GND rest member 28 are respectively brought into contact with the terminal electrode 12 and the GND electrodes 16*b*, 16*b* to achieve electrical connection, utilizing the elasticity of the core conductor 22*c*. Moreover, as shown in FIGS. 8A and 8B, a shallow recess 20*c* in a round shape, for example, is formed around a surface of the through hole 20*a* in the main block 20 through which the core conductor 22*c* is projected. This recess 20*c* creates a clearance between the main block 20 and the end part of the board 10 which has been inserted, and can prevent the terminal electrode 12 of the board 10 from coming into contact with the main block 20 to be electrically connected. However, it is desirable that a depth of this recess 20*c* is less than 1/20 of electrical wavelength of measuring frequency (for example, 18 GHz) which is dealt with by this relay connector according to the invention. This is because a structure of a coaxial path which is formed in an area where this recess 20*c* is formed is different from a structure of a coaxial path which is formed in the other area, in respect of a diameter of its outside conductor, and impedance in the area around the recess is different from impedance in the other area. It is necessary to restrict the depth of the recess 20*c* for the purpose of eliminating influence of the difference to the least.

Figure 9:
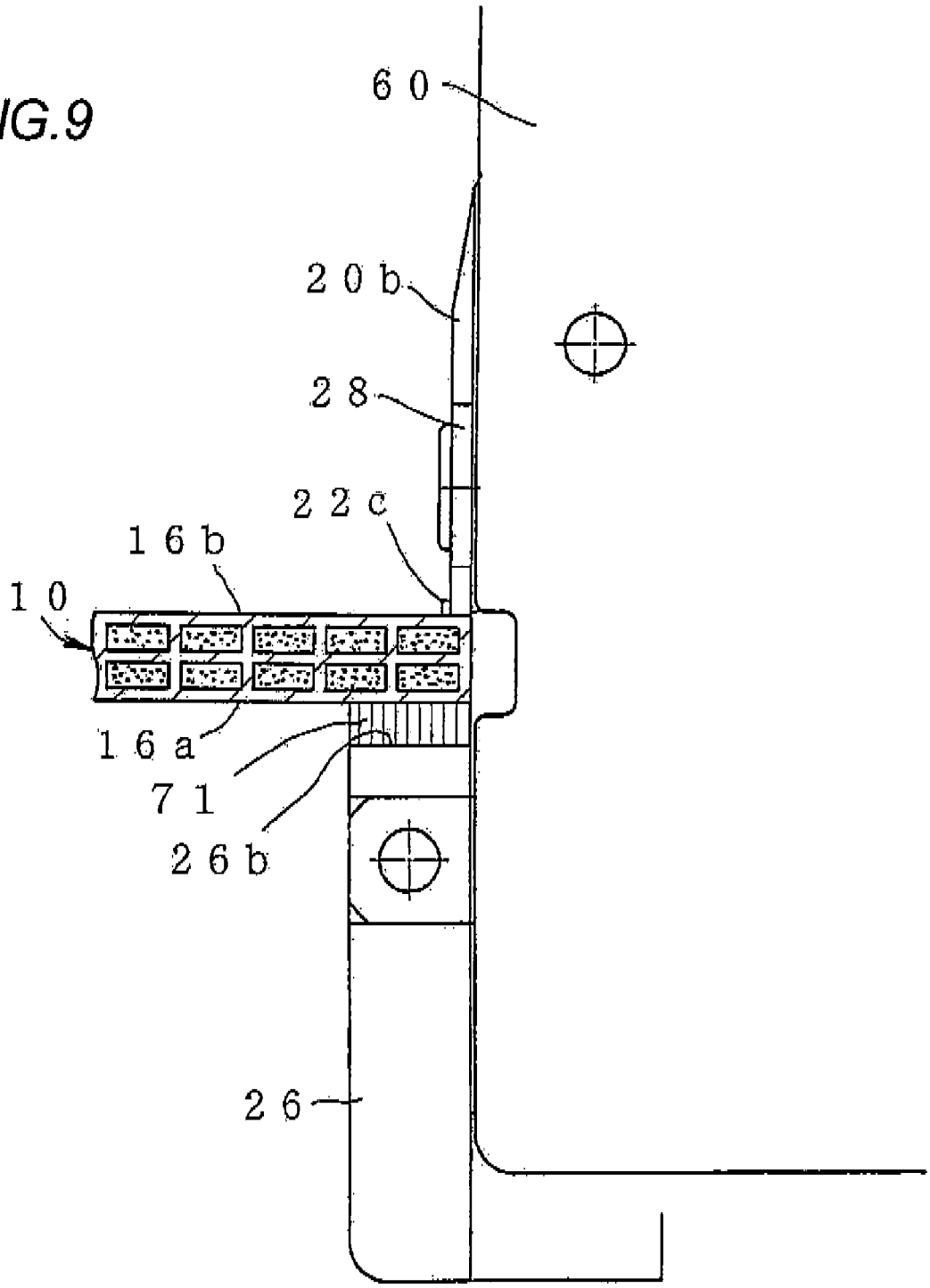
FIG. 9 is a side view of a board rest part of a GND block of a relay connector in a second embodiment according to the invention.

Then, a second embodiment according to the invention will be described referring to FIG. 9. In FIG. 9, those members which are the same or equivalent to those in FIGS. 1A to 8B, and FIGS. 12A to 14 will be denoted with the same reference numerals and overlapping descriptions will be omitted.

In the second embodiment as shown in FIG. 9, conductive rubber 71 is provided on the board rest part 26*b* of the GND block 26. There is undulations on a surface of the GND electrode 16*a* on the back surface of the board 10, because insulating resist is applied to a region where electrical connection is not required, for the purpose of preventing oxidation of metal and unnecessary stick of solder during a soldering step, and further, because a region which has been soldered for connecting through holes is made higher as compared with a region where no coating is applied for electrical connection. Consequently, when the board rest part 26*b* having a flat surface is brought into contact with the back surface of the board 10, the GND electrode 16*a* which is dented cannot be contacted with the board rest part 26*b*, in some cases. Therefore, by providing the conductive rubber 71 which is elastically deformed according to the undulations of the back surface of the board 10, it is possible to electrically connect the GND electrode 16*a* to the board rest part 26*b* reliably. The conductive rubber 71 must have such a thickness that it can sufficiently absorb the undulations on the back surface of the board 10.

Figure 10:
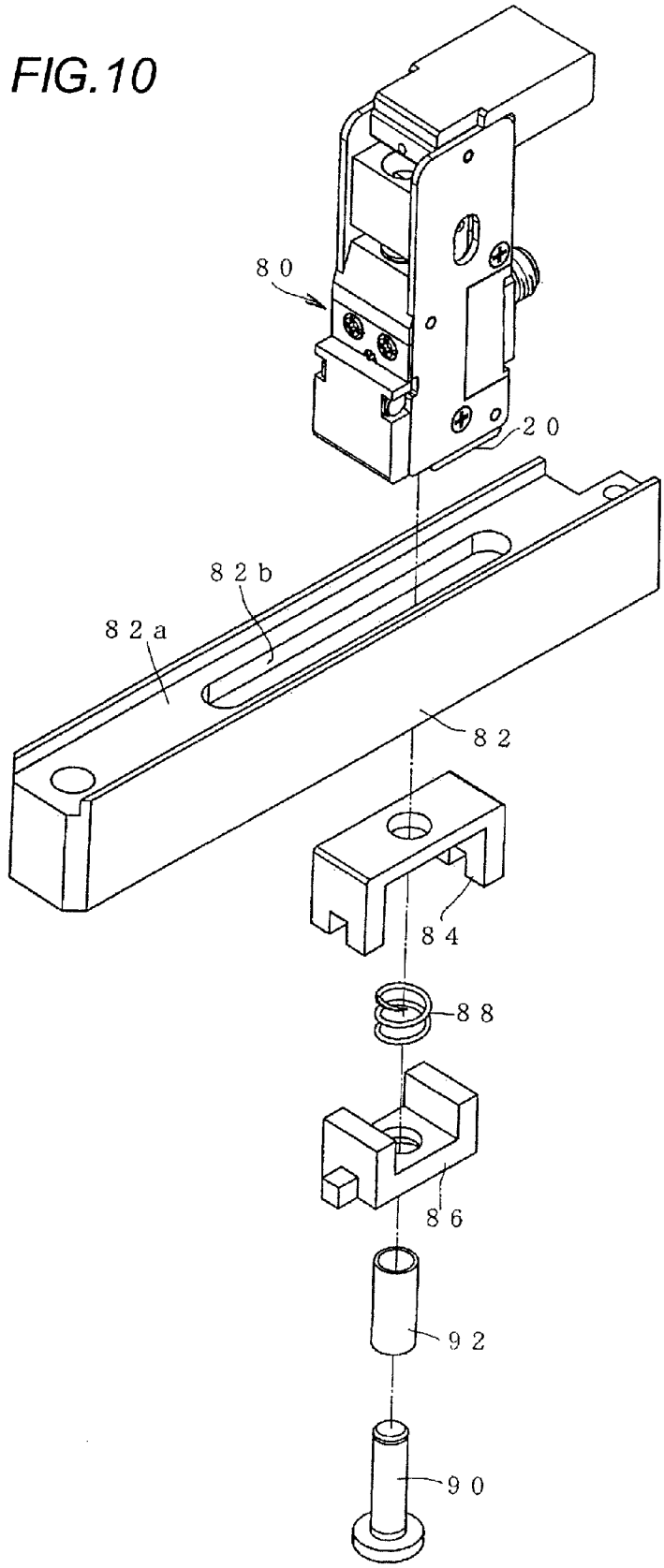
FIG. 10 is an exploded perspective view of a relay connector in a third embodiment according to the invention in which the relay connector is disposed on a slide rail so as to freely move.
Figure 11:
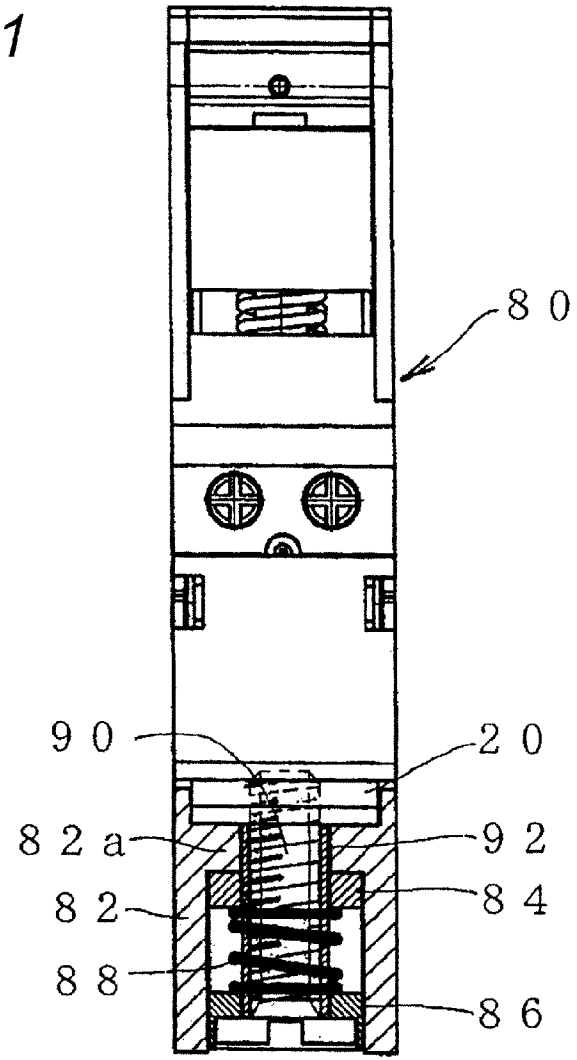
FIG. 11 is a vertical sectional view of the relay connector in FIG. 10 in an assembled state.
Figure 12:
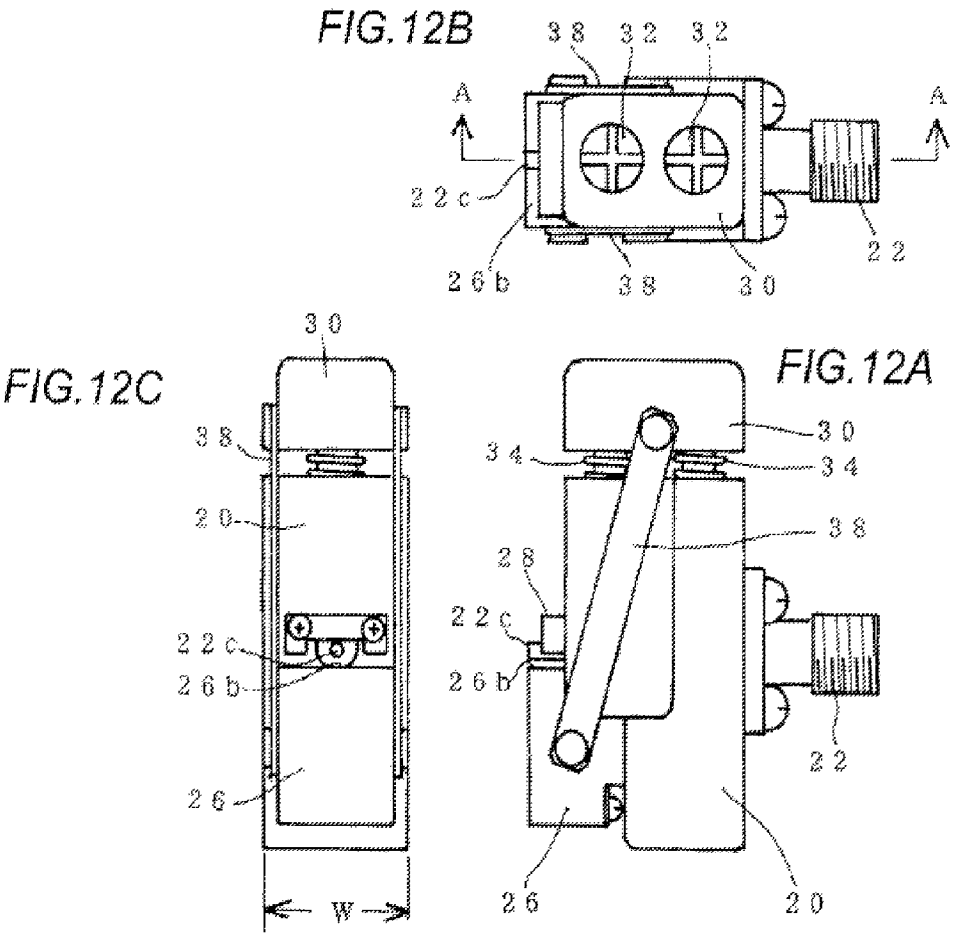
FIGS. 12A, 12B and 12C are views showing an outer appearance of a related-art relay connector.
Figure 13:
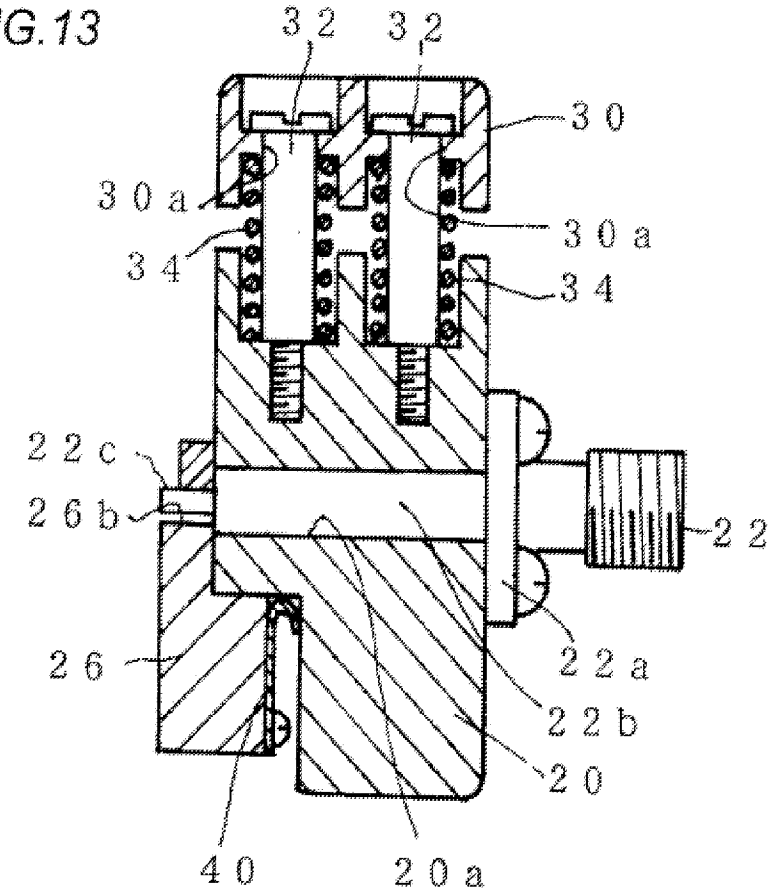
FIG.13 RELATED ART
FIG. 13 is a sectional view taken along a line A-A in FIG. 12B.
Figure 14:
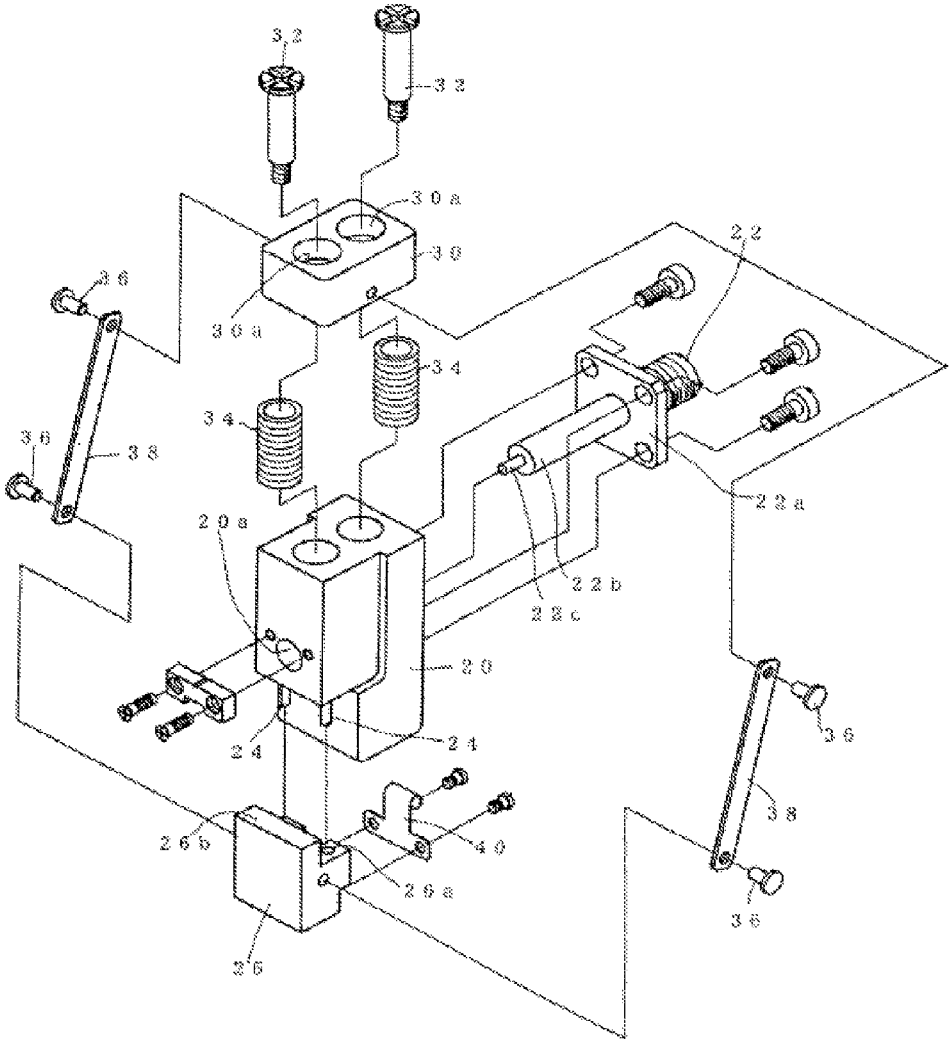
FIG. 14 is an exploded perspective view of the relay connector as shown in FIGS. 12A to 12C.

Further, a third embodiment according to the invention will be described referring to FIGS. 10 and 11. In FIGS. 10 and 11, those members which are the same or equivalent to those in FIGS. 1A to 9, and FIGS. 12A to 14 will be denoted with the same reference numerals and overlapping descriptions will be omitted.

In the third embodiment as shown in FIGS. 10 and 11, a slide rail 82 is elongated in a direction perpendicular to the moving direction of the GND block 26, and has a generally H-shape in cross section having upper and lower openings respectively in a U-shape in section. A lower end portion of the main block 20 of a relay connector 80 is inserted into the upper U-shaped opening so as to move in the longitudinal direction. A width of this slide rail 82 is equal to a width of the shell GND 22*a* of the coaxial connector 22, and the lower end portion of the main block 20 is made narrower in width, by being shaved at both sides so that it can be inserted into the upper U-shaped opening. Moreover, a longitudinally elongated hole 82*b* is formed in a middle part 82*a* of the slide rail 82 (the middle part where the upper and lower U-shaped openings are formed). A first inclination preventing member 84 is inserted into the lower U-shaped opening so as to move in the longitudinal direction, and a second inclination preventing member 86 is assembled to this first inclination preventing member 84 from below. A spring 88 is provided between the first and second inclination preventing members 84, 86 in a contracted state. Further, a screw 90 is passed from below, passing through the second inclination preventing member 86, the first inclination preventing member 84, and the elongated hole 82*b* of the slide rail 82 to be screwed and fixed to a bottom of the main block 20. A collar 92 is inserted into the first and second inclination preventing members 84, 86 and the elongated hole 82*b*. The screw 90 is inserted into this collar 92, and the spring 88 is idly fitted to this collar 92. In a state where the screw 90 is fixed by screwing, there is an appropriate clearance between the first and second inclination preventing members 84, 86.

In the above described structure, the bottom of the main block 20 is elastically contacted with the middle part 82*a* of the slide rail 82 by elasticity of the spring 88 in a stabilized state. Moreover, the relay connector 80 will not rotate, because its orientation is restricted by erected portions at both sides of the upper U-shaped opening. Further, the relay connector will not be inclined back and forth in the projecting direction of the core conductor 22*c*, because of the first and second inclination preventing members 84, 86. As the results, the relay connector 80 can be stably disposed on the slide rail 82. By lifting the main block 20 from the slide rail 82 against the elasticity of the spring 88, the bottom of the main block 20 is separated from the middle part 82*a* of the slide rail 82, and the relay connector can be easily moved back and forth. When the main block 20 is lifted from the slide rail 82, the first inclination preventing member 84 is likely to strike a lower surface of the middle part 82*a* of the slide rail 82. For avoiding this, a structure having an adequately small coefficient of friction is recommended. Because the relay connector 80 can be moved back and forth along the slide rail 82 in this manner, it is possible to easily move the relay connector 80 close to the board to be inspected for electrical connection, after the board to be inspected has been set on a jig or the like.

In the above described embodiment, the structure for electrically connecting the GND block 26 to the main block 20 is not limited to the structure in which the spring connectors 42, 42 are used, as described above, but they may be electrically connected by means of a conductive leaf spring or a flexible wire. Any structure may be employed, provided that reliable electrical continuity can be obtained. Moreover, the slide rail 82 in the third embodiment may have such a sectional shape that at least the upper U-shaped opening is provided, so that the orientation of the relay connector 80 can be restricted, and the lower U-shaped opening may be omitted.

According to an aspect of the invention, the GND block is provided so as to reliably move with respect to the main block in slidably contact with the main block by means of the guide pin and the guide hole, in a linear direction parallel to the surface from which the core conductor is projected, and the screw passed through the through hole which is formed in the operating member is screwed into the main block so that the operating member can move with respect to the main block in parallel with the moving direction of the GND block in a determined range, and the operating member is coupled to the GND block by the coupling member to be made integral. Therefore, posture of the GND block is restricted by the guide pin and guide hole, and by the through hole which is formed in the operating member and the screw which has been passed, and hence, the GND block is relatively moved with respect to the main block in a stabilized posture. As the results, electrical connection between the main block and the GND block can be made constant, and at the same time, the board rest part is contacted with the GND electrode on the back surface of the board in a stabilized state.

According to an aspect of the invention, the coupling member is formed in a substantially L-shape, one end of the coupling member being inserted into the groove which is formed in the operating member in parallel with a moving direction of the GND block to be fixed thereto, the other end of the coupling member being inserted into the groove which is formed in the GND block in a direction perpendicular to the moving direction of the GND block to be fixed thereto, whereby the GND block which is provided in sliding contact with the surface of the main block from which the core conductor is projected is made integral with the operating member which is disposed on the main block at an opposite side to the GND block with respect to the core conductor, by means of the coupling member. As the results, the GND block and the operating member of which moving directions are parallel to each other and displaced can be made integral in a simple structure.

Moreover, according to an aspect of the invention, the surface GND rest member disposed on the main block is contacted with the GND electrode which is provided on the surface of the board for electrical continuity, and the core conductor is slightly flexed and elastically contacted with the terminal electrode on the surface of the board. In this manner, this relay connector can be applied to the board which is provided with the GND electrode on its surface.

Further, according to an aspect of the invention, the end part of the main block is inserted into the slide rail which is provided with at least the upper opening in a U-shape in cross section so as to freely move, and the screw which is passed through the slide rail from the below is screwed into the main block. As the results, the main block will not rotate, because its posture is restricted by the slide rail which is provided with at least the upper opening in a U-shape in cross section, and can move only in a fixed direction. At the same time, the main block will not be detached from the slide rail.

What is claimed is:

1. A relay connector for electrically connecting a board and a coaxial connector, the coaxial connector including: a shell GND; a dielectric member projected from the shell GND; and a core conductor peeled out of the dielectric member, the relay connector comprising:

a conductive first block including a first through hole into which the dielectric member is inserted, the first block including a first surface from which the core conductor is projected and a second surface which is opposite to the first surface to which the shell GND is fixed, the first block provided with a guide pin extending in a first direction parallel to the first surface;

a conductive second block including a board rest part on which the board is to be mounted, the second block including a guide hold into which the guide pin is inserted, the second block formed with a first groove, the second block being electrically connected to the first block and being movable in the first direction in slidably contact with the first block;

an operating member provided on the first block at an opposite side to the second block with respect to the core conductor, the operating member formed with a second groove, the operating member including a second through hold which extends in the first direction and into which a screw being screwed into the first block is inserted, the operating member being movable in the first direction;

an elastic member provided between the operating member and the first block in a contracted state to elastically urge the operating member so as to move apart from the first block; and a coupling member, one end of which is fitted into and fixed to the first groove of the second block, the other end of which is fitted into and fixed to the second groove of the operating member.

2. The relay connector according to claim 1, wherein the first groove of the second block extends in a second direction perpendicular to the first direction, the second groove of the operating member extends in the first direction, the coupling member includes a first portion which extends in the first direction and which is fitted into the second groove and a second portion which extends in the second direction and which is fitted into the first groove so that the coupling member has a substantially L-shape.

3. The relay connector according to claim 1, further comprising:

a conductive surface GND rest member disposed on the first surface of the first block at an opposite side to the second block with respect to the core conductor, the surface GND rest member including a surface which is opposed to and parallel with the board rest part of the second block and which is formed with a recess so as not to be in electrically contact with the core conductor.

4. The relay connector according to claim 1, wherein an end part of the first block at an opposite side to a side at which the operating member is provided is inserted into a slide rail, the slide rail elongated in a second direction perpendicular to the first direction, the slide rail having at least one opening being opened to the first block, the slide rail fixed to the first block by a screw so as to be movable in the second direction.

5. The relay connector according to claim 1, wherein the first block is formed with a groove in which the coupling member is fitted and along which the coupling member moves in the first direction.

* * * * *